US006170765B1

(12) United States Patent
Gil et al.

(10) Patent No.: US 6,170,765 B1
(45) Date of Patent: Jan. 9, 2001

(54) PRESSURE ACTUATED SHOWER HEAD MECHANISM

(76) Inventors: Amos Gil, 34445 Lakehurst Dr., Farmington Hills, MI (US) 48331; Ben Ami, c/o Metadin Company, 31 Tovim Street, Shemin Industrial District, Haifa (IL)

( * ) Notice: Under 35 U.S.C. 154(b), the term of this patent shall be extended for 0 days.

(21) Appl. No.: 08/999,326

(22) Filed: Dec. 29, 1997

(51) Int. Cl.[7] ..... B05B 1/32

(52) U.S. Cl. ..... 239/539; 239/541; 239/562; 239/570; 239/581.2; 251/251

(58) Field of Search ..... 239/380, 381, 239/382, 443, 446, 451, 452, 453, 456, 457, 464, 518, 524, 533.1, 533.15, 541, 548, 562, 571, 579, 539, 540, 581.1, 581.2, 570; 251/251; 137/801

(56) References Cited

U.S. PATENT DOCUMENTS

| | | | | |
|---|---|---|---|---|
| 1,832,724 | * | 11/1931 | Mueller | 239/539 |
| 1,917,216 | * | 7/1933 | Bersted | 239/457 |
| 2,096,912 | * | 10/1937 | Morris | 239/540 |
| 2,727,784 | * | 12/1955 | Hansen | 239/452 X |
| 2,756,108 | * | 7/1956 | Warren | 239/457 |
| 2,990,123 | * | 6/1961 | Hyde | 239/524 X |
| 3,061,199 | * | 10/1962 | Billeter | 239/452 X |
| 3,116,880 | * | 1/1964 | Kuiken | 239/524 X |
| 3,558,054 | * | 1/1971 | Ragot | 239/539 X |
| 3,784,113 | * | 1/1974 | Specht | 251/251 X |
| 3,979,064 | * | 9/1976 | Nordentoft | 239/541 X |
| 5,370,316 | * | 12/1994 | Lancaster | 239/562 X |
| 5,632,446 | * | 5/1997 | Krochek | 239/464 X |

* cited by examiner

*Primary Examiner*—Andres Kashnikow
*Assistant Examiner*—Steven J. Ganey

(57) ABSTRACT

A shower head having a water inlet passage for providing a supply of water to the shower head and a plurality of nozzles for expelling water from the shower head. The flow of water from the water inlet passage to the nozzles is controlled by a pressure actuated toggle valve mechanism. The valve mechanism is in communication with a rotatable bottom portion of the shower head and rotates as the bottom portion of the shower head rotates. The valve mechanism can adjust the flow of water to the nozzles and shut it off altogether.

19 Claims, 2 Drawing Sheets

PRESSURE ACTUATED SHOWER HEAD MECHANISM

TECHNICAL FIELD

The present invention relates to a design for a shower head. More particularly, the present invention relates to a pressure actuated toggle assembly for a shower head that allows for the turning on and shutting off of water flow through the shower head as well as the control of water flow therethrough.

BACKGROUND ART

Standard shower head assemblies are known in the art that have an adjustment ring that can be turned to vary the type and amount of water flow from the shower head. The ring can vary the volume of water flowing through the shower head and can switch the shower head between different spray modes, for instance concentrating flow from a single central large diameter orifice or from an array of peripheral small-diameter orifices or nozzles.

Numerous other shower head assemblies are known in the art that can be adjusted to discharge a continuous spray or a pulsating spray. Typical of such shower heads are those disclosed in U.S. Pat. Nos. 3,801,019, 4,068,801, and 4,254,914. U.S. Pat. No. 3,801,019, for example, discloses a spray nozzle capable of delivering both a spray of water and pulsating water, and employing three sets of flow passages. Control of the frequency of pulsation or the apportionment of spray through the flow passages is accomplished by adjusting a shuttered plate relative to a flow directing plate. U.S. Pat. No. 4,068,801 discloses a spray head in which the water is caused to rotate and drive a rotor. The rotor has openings that pass intermittently across jet nozzles (for pulsating spray) or perforations (for steady spray).

These designs have been bulky and complex in that they require a variety of parts that increase the cost of the shower head. Additionally, it has been found that because of the many moving parts, these prior designs are susceptible to problems from build-up of water deposits. These concerns fostered new designs, including those disclosed in U.S. Pat. Nos. 5,246,139, 5,398,372, and 5,518,181. U.S. Pat. No. 5,246,159 discloses a shower head with a rotatable valve element that rotates with respect to a partition disk. The shower head has a plurality of apertures that when the valve element is rotated through a variety of positions direct the water flow through the appropriate apertures.

None of these designs effectively solved the problem of decreasing the bulk, complexity, cost, and water deposit build-up, while providing an efficient shower head. Moreover, these shower head designs have not effectively incorporated a shut-off valve or toggle valve mechanism that not only allows the flow to be varied by manipulation of the shower head, but also allows the flow to be shut off.

DISCLOSURE OF THE INVENTION

It is an object of the present invention to provide a shower head with a toggle valve mechanism that is resistant to water deposit build up.

It is another object of the present invention to provide a toggle valve mechanism that is less complex than prior mechanisms and requires less moving parts.

It is still another object of the present invention to provide a simple valve mechanism that allows for the manipulation of the shower head to vary the flow of water through the outlet orifices.

It is still a further object of the present invention to provide a toggle valve and variable flow mechanism that operates based on the water pressure present in the shower head.

It is yet a further object of the present invention to provide a toggle valve that allows the water flow to be shut-off or varied and is kept in its desired place by the water pressure in the shower head without the need for any other securing mechanism.

In accordance with the objects of the present invention a shower head with an inlet passage is provided. The inlet passage is connected to a water source to provide a water supply to the shower head body. The shower head body is partitioned into an upper half and a lower half with a fluid channel connecting the upper half of the shower head body with the lower half of the shower head body. The lower half of the shower head has a plurality of fluid nozzles formed in its bottom surface for expelling water from the shower head. The fluid channel includes a toggle valve mechanism that helps regulate the amount of water flowing from the upper half of the shower head body to the lower half of the shower head body. The lower half of the shower head body is rotatable and is in communication with the pressure actuated valve mechanism such that rotation of the lower half of the shower head body will vary the amount of water flowing through the mechanism. The toggle valve mechanism is pressure actuated in that once it is set in place such that the desired flow through the shower head is achieved, the water pressure from the water source retains the toggle valve mechanism in that position thus preventing further movement.

In one preferred embodiment, the toggle valve mechanism includes a turn key having a top portion and a stem. The stem of the turn key extends through the fluid channel and into contact with the lower half of the shower head body. The top portion of the turn key has an under side that contacts and is slidable upon a ridge portion in the fluid channel. The ridge portion has a pair of opposing grooves or detents formed in its surface for mating engagement with the turn key. When the turn key is in a non-mating relationship with the grooves, the valve mechanism is open and water is allowed to flow from the upper half of the shower head body to the lower half of the shower head body through the fluid channel. When the turn key is in a mating relationship with the grooves, the valve mechanism is closed preventing the flow of water from the upper half of the shower head body to the lower half of the shower head body.

While an embodiment of this invention is illustrated and disclosed, this embodiment should not be construed to limit the claims. It is anticipated that various modifications and alternative designs may be made without departing from the scope of this invention.

DETAILED DESCRIPTION OF THE INVENTION

Figure 1:
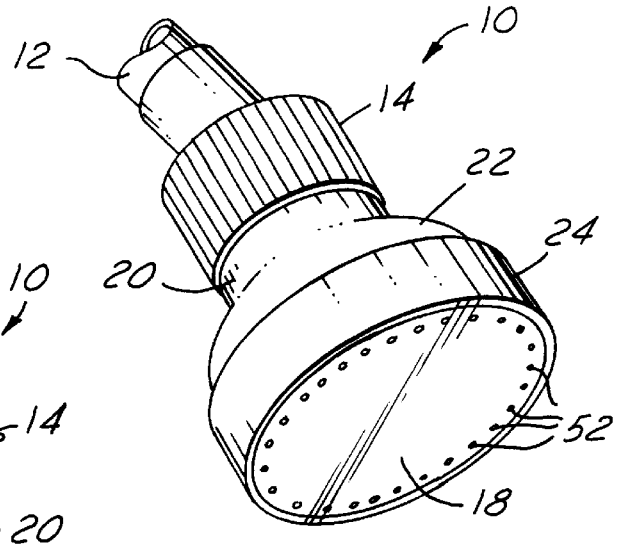
FIG. 1 is perspective view of a shower head assembly in accordance with the present invention.

FIGS. 1 through 5 illustrate a shower head in accordance with a preferred embodiment of the present invention. The shower head 10 is connected to a water source (not shown) by a water input line 12. The shower head 10 is connected to the water input line 12 by a connector 14, of the type which is well known in the art. The connector 14 allows the shower head 10 to be manipulated through a variety of positions. It should be understood that the shower head 10 may be permanently attached to a shower wall or may be of the hand held type that can be removed from the shower wall. Also, other types of connections between the water input line 12 and the shower head 10 can be employed. The shower head 10 is preferably constructed of a plastic material, but may be formed of other known materials.

The shower head 10 has a top surface 16, a bottom surface 18, a generally cylindrical neck portion 20, a generally bell-shaped bottom portion 22, and a circular rotating portion 24 that terminates in the bottom surface 18. The directional terms such as "up", "down", "top", and "bottom" are used herein for orientation purposes only with respect to the figures and are not intended to refer to the shower head as it is oriented in use or as it is mounted in a shower.

Figure 2:
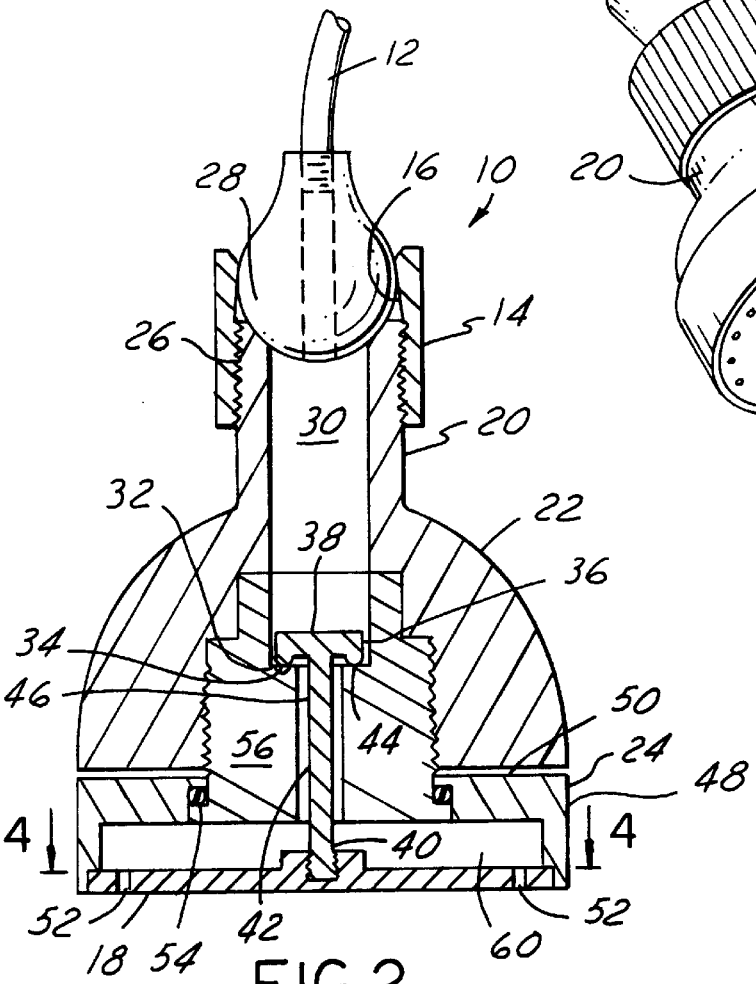
FIG. 2 is a cross-sectional view of a shower head assembly in accordance with a preferred embodiment of the present invention.

As shown in FIG. 2, the connector 14 has a plurality of threads 26 that secure the connector 14 to the generally cylindrical neck portion 20. In the preferred embodiment, threads are located on both the neck portion 20 and the connector 14. The attachment of the connector 14 to the generally cylindrical neck portion 20 allows water from the water inlet line 12 to flow into fluid passage 30 through a shower ball or opening 28. The connector 14 not only places the shower head body 10 in fluid communication with the water inlet line 12, but it also provides a leak free connection, to prevent water from leaking at the joint where the shower head 10 and water inlet line 12 are attached.

Figure 3:
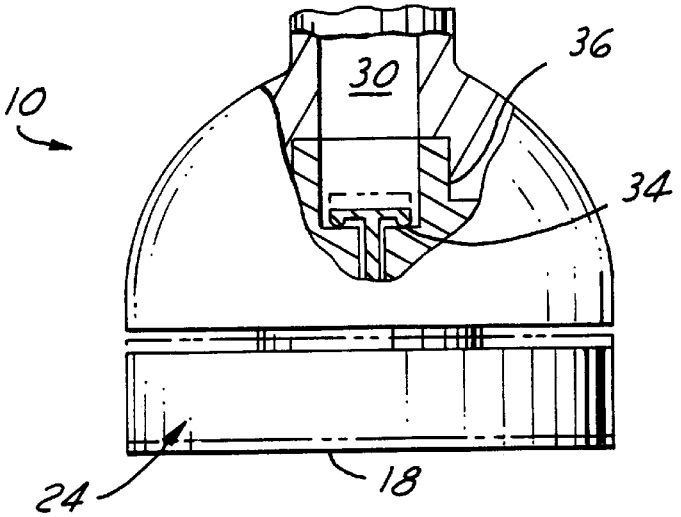
FIG. 3 is a side view broken away illustrating the toggle valve mechanism in accordance with the present invention.
Figure 4:
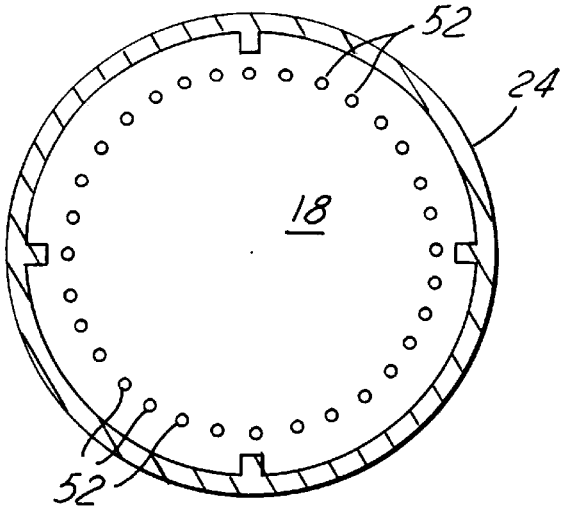
FIG. 4 is a bottom plan view of a shower head in accordance with a preferred embodiment of the present invention.
Figure 5:
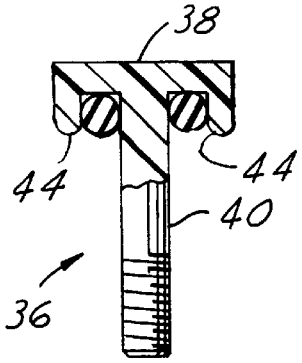
FIG. 5 is a side view of a portion of one preferred toggle valve mechanism in accordance with the present invention.

The shower head body 10 has a fluid passage 30 formed therein that receives the water after it passes through the shower ball 28 in the top surface 16 of the shower head body 10. The fluid passage 30 is defined by the top surface 16 and a ridge or shoulder portion 32. The ridge portion 32 has at least one groove or detent 34 formed therein. The ridge portion 32 is preferably flat or parallel with respect to the top surface 16 of the shower head body 10, but may alternatively be inclined or cammed, as shown in FIG. 3.

A valve mechanism 36 is preferably disposed within the fluid passage 30. The valve mechanism 30 includes a top portion 38 and a stem 40. The top portion 38 of the valve mechanism 36 is generally rectangular in shape, but may alternatively be another shape, including circular or triangular. The top portion 38 of the valve mechanism 36, must however fit within the fluid passage 30 and be of a size and shape to allow water from the fluid passage 30 to pass thereby into an internal passage 42.

The top portion 38 of the valve mechanism 36 has an underside upon which at least one protrusion 44 is formed. In the preferred embodiment, two protrusions 44 are present and they are formed on either side of the top portion 38. The protrusions 44 are designed to contact the surface 32 which is a helical surface such that when the protrusions 44 are contacting the lowest portion of the helix, the flow of water is prevented from flowing from the fluid passage 30 to the internal passageway 42. The grooves 34 preferably have opposing sides 46. The opposing sides 46 are generally divergent from the bottom of the grooves 34 to allow the protrusions 44 to easily engage and disengage the grooves 34.

The stem 40 of the valve mechanism 36 extends downwardly through the internal passageway 42 and is secured to the bottom surface 18 of the circular rotating portion 24. The circular rotating portion 24 is not secured to the remainder of the shower head body 10 and has a bottom surface 18, a circular periphery 48, and a top portion 50. The circular rotating portion 24 defines a water chamber 60 therein which receives and houses water passed through the internal passageway 12 before it exits the orifices 52. A annular seal 45 (FIG. 5) is located on the undersurface of the top portion to seal the fluid passage 30 from the internal passage 43.

The bottom surface 18 has a plurality of water orifices or nozzles 52 formed about its periphery. As the stem 40 is connected to the circular rotating portion 24, the top portion 38 of the valve mechanism 36 rotates as the circular rotating portion 24 is rotated. An O-ring 54 is interposed between the top portion 50 and an internal flange 56 that extends below the bell-shaped body 20 and surrounds the internal passage 42. This connection keeps the circular rotating portion 24 in contact with the shower head body 10, but allows it to rotate freely.

In operation, as the circular rotating portion 24 is rotated (either clockwise or counter-clockwise) the valve mechanism 36 is caused to rotate in the same direction. As the valve mechanism 36 is rotated, the helical or cam surface 34 causes the valve mechanism 36 to move away from the internal flange 56, allowing water to flow. When the valve mechanism 36 is in the lowest position relative to the internal flange 56, the flow of water from the inlet pipe 12 is shut off and no water flows through the internal passage 42, into the water chamber 60, and out the nozzles 52. The valve mechanism 36 is kept in place in the grooves 34 by the water pressure. It should be understood that the term shut-off is not intended to mean 100% or complete stoppage of water flow. This because it is often desirable to have a trickle in the shut-off position.

When the valve mechanism 36 is rotated such that the valve mechanism moves away from the internal flange 56, water is allowed to pass through the internal passage 42, into the water chamber 60, and out the plurality of nozzles 52. Again, the valve mechanism 36 is held in position by the water pressure in the shower head body 10. The profile of surface 32 may be varied such that the distance between the top portion 38 of the valve mechanism 36 and the internal passage 42 is adjustable. Thus, the amount of water that will flow through the passage 42 is adjustable.

Figure 6:
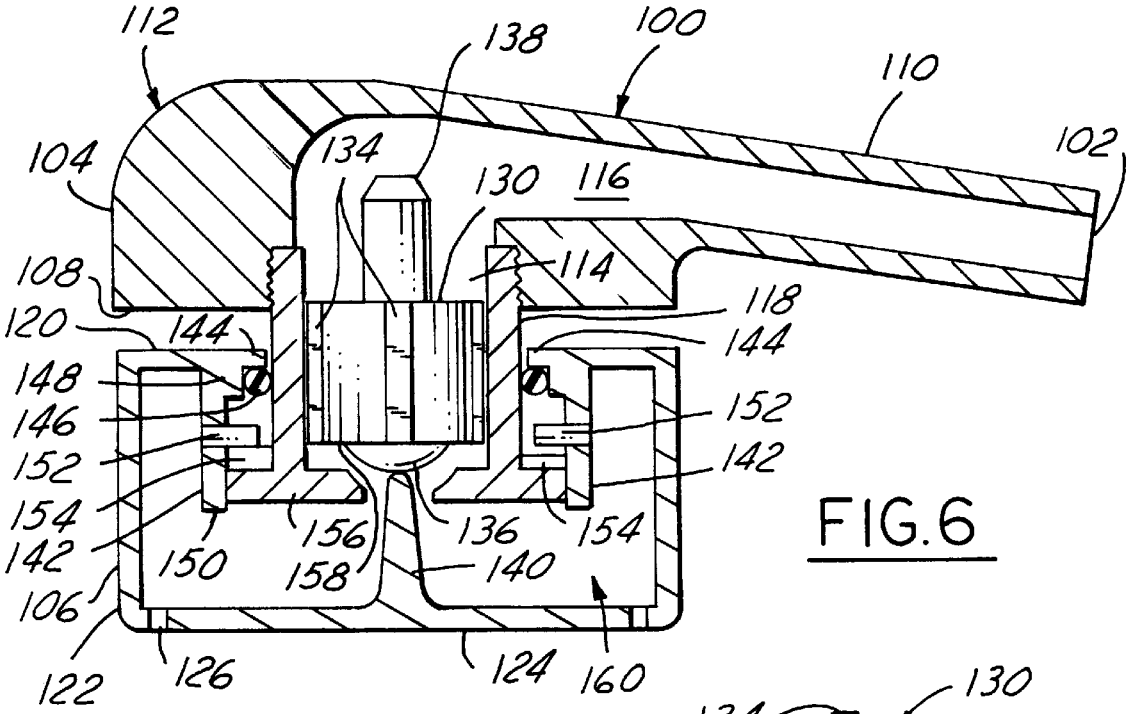
FIG. 6 is a cross-sectional view of a shower head assembly in accordance with another preferred embodiment of the present invention.
Figure 7:
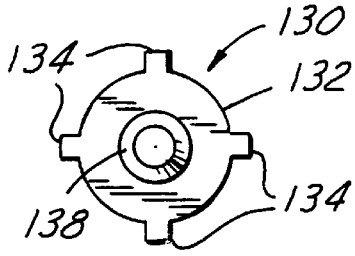
FIG. 7 is a top view of the toggle valve mechanism shown in FIG. 6.

Turning now to FIGS. 6 and 7 which illustrates another preferred embodiment of the present invention. As shown in FIG. 6, the shower head 100 is connected to a water input line 102. The shower head 100 has an upper portion 104 and a lower portion 106, with the upper portion 104 being connected to the water input line 102. The upper portion 104 has a generally planar bottom surface 108, a neck portion 110 which is connected to the water input line 102, and a semi-spherical portion 112. The upper portion 104 and the lower portion 106 are each preferably one-piece integrally molded pieces.

The upper portion 104 has a generally cylindrical passage 114 formed in its bottom surface 108. The cylindrical passage 114 is in fluid communication with the water input line 102 by a water passage 116 formed in the neck portion 110 and the semi-spherical portion 112. A retainer 118 is attached to the outer surface of the generally cylindrical passage 114 by grooves, teeth, or other known apparatus for attachment. The lower portion 106 has a top surface 120 through which the retainer 118 is received, a generally circular periphery 122, and a bottom surface 124, through which a plurality of spray nozzles 126 or orifices are formed.

A valve mechanism 130 is preferably disposed within the cylindrical passage 114. As shown in FIG. 7, the valve mechanism 130 includes a generally cylindrical body portion 132, a plurality of rib portions 134 formed on the surface of the generally cylindrical body portion 132, a rounded bottom portion 136, and a stop member 138 that extends from the generally cylindrical body portion 132. The diameter of the generally cylindrical body portion 132 is less than the retainer 118 in which it sits. Additionally, the diameter of the valve mechanism 130 as measured from its outermost portion (the tip of the ribs 134) is also less than the inner diameter of the retainer 118. This allows the valve mechanism 130 to move freely within the retainer 118. However, the diameter of the ribs 134 must not be so small as to allow the valve mechanism 130 to rotate about a horizontal axis and block the flow of water from the water inlet line 102.

The rounded bottom portion 136 rests on a finger 140 extending upwardly from the bottom surface 124 of the lower portion 106 of the shower head 100. The lower portion 106 is rotatable to adjust the flow of water that exits the plurality of nozzles 126 until the flow of water is shut off completely.

The lower portion 106 has an opening through which the retainer 118 is received. The opening is defined by a downwardly extending ring portion 142 and a projection portion 144. The projection portion 144 extends towards the retainer 118 and contacts an O-ring 146 positioned beneath the projection portion 144. The O-ring 146 is bounded on its top by the projection portion 142 of the lower portion 106, on its inner side by the outer surface of the retainer 118 and on its outer surface by the upper portion 148 of the downwardly extending ring portion 142.

The lower portion 150 of the downwardly extending ring portion 142 has a pair of pins 152 extending outwardly therefrom. It should be understood that more or less pins 152 may be utilized. The pins 152 extend into contact with a cam surface 154 located on a bottom portion 156 of the retainer 118. As the lower portion 106 of the shower head 100 is rotated, the pins 152 rotate along the cam surface 154 and adjust the height of the finger 140 and thus the height of the valve mechanism 130 within the retainer 118. When the pins 152 are at the lowest point of the cam surface 134, the valve mechanism 130 is positioned in the retainer 118 to shut off the flow of water from the water supply line 102.

When in the closed or shut off position, the bottom surface 158 of the valve mechanism 130 contacts the bottom portion 156 of the retainer 118 that extends into the opening. By rotation of the lower portion 106, the valve mechanism 130 is lifted upwards by the finger 140 and water is allowed to travel from the cylindrical passage 114 into the lower portion 106 of the shower head 100. The lower portion 106 includes a water chamber 160 in which water is housed before it is expelled from the plurality of spray nozzles 126. The upward movement of the valve mechanism 130 is limited by the stop member 138 extending generally upward therefrom.

While the valve mechanism is not permanently affixed to any component, it is maintained in a shut off position by water pressure in the cylindrical passageway 114. Thus, the valve mechanism 130 will not become unseated from the shoulder portions 156 and allow water to flow into the lower portion 106 of the shower body 100. Additionally, a plurality of grooves (not shown) can be formed into the cam surface 154 to effectuate the shut-off of water flow.

While embodiments of the invention have been illustrated and described, it is not intended that such disclosure illustrate and describe all possible forms of the invention. It is intended that the following claims cover all modifications and alternative designs, and all equivalents, that fall within the spirit and scope of this invention.

What is claimed is:

1. A shower head comprising:

a housing having a body, a rotatable portion, a shower face including a plurality of spray nozzles, and a water chamber;

a water inlet line providing a source of water to said shower head;

a fluid passageway formed in said shower head allowing water to flow from said water inlet line to said rotatable portion;

a valve mechanism located within said housing, said valve mechanism including a top portion which rotates along a cam surface to adjust the flow of water into said water chamber;

said rotatable portion in communication with said valve mechanism to regulate the flow of water through said fluid passageway.

2. The shower head of claim 1, wherein said valve mechanism is secured to said rotatable portion of the shower head such that said valve mechanism rotates with said rotatable portion.

3. The shower head of claim 1, wherein said top portion further includes at least one protrusion formed on its underside for following the cam surface to shut off the flow of water through said fluid passage and into said water chamber.

4. The shower head of claim 3, wherein said cam has a valley and a pair of sloped sides allowing said at least one protrusion to slide into and out of communication therewith.

5. The shower head of claim 2, wherein said valve mechanism is rotatable through the rotation of said rotatable portion between an open position and a closed position and varying positions therebetween and wherein said valve mechanism is kept in position by the water pressure from said water inlet line.

6. A shower head comprising:

an inlet passage for receiving water from a water source;

a shower head body, including a first half and a second half;

a fluid channel placing said first half of said shower head body in fluid communication with said second half of said shower head body;

said second half of said shower head being rotatable; and a toggle valve mechanism regulating the flow of water between said first half of said shower head and said second half of said shower head, whereby said toggle valve mechanism is maintained in its desired position by the water pressure in the shower head, wherein said toggle valve mechanism has a top portion and a stem portion with said top portion contacting a cam surface formed in said shower head body at the inlet to said fluid channel.

7. The shower head of claim 6, wherein said stem portion extends through said fluid passageway and is secured to said second half of said shower head whereby said valve mechanism rotates as said second half of said shower head is rotated.

8. A shower head comprising:

a housing having a body, a rotatable portion, a shower face including a plurality of spray nozzles, and a water chamber;

a water inlet line providing a source of water to said shower head body;

a fluid channel having an inlet allowing water from said water inlet line to flow from said body to said rotatable portion, said fluid channel having an annular surface disposed around the periphery of said fluid channel inlet;

a valve mechanism disposed in said fluid channel and having a top portion that contacts said annular surface and a stem portion that extends into contact with said rotatable portion, such that as said rotatable portion is rotated, said top portion of said valve mechanism is rotated between a closed position preventing fluid from flowing through said fluid channel and an open position whereby fluid can flow through said fluid channel;

whereby said valve mechanism is maintained in either said open position or said closed position by water pressure in the shower head.

9. The shower head of claim 8, wherein said annular surface is cammed so that as said top portion of said valve mechanism rotates, it moves generally upward and away from said fluid channel.

10. The shower head of claim 9, wherein said valve mechanism can be rotated through a variety of open positions to vary the flow of water through said fluid channel.

11. The shower head of claim 8, wherein said top portion further includes at least one protrusion formed on its underside which contacts said annular surface as said rotatable portion is turned.

12. The shower head of claim 11, wherein said annular surface has at lease one groove formed therein allowing said at least one protrusion to slide into and out of communication therewith.

13. A shower head assembly, comprising:

an inlet passage for receiving water from a water source;

a shower head body, including a first portion and a second portion;

a fluid passage placing said first portion of said shower head body in fluid communication with said second portion of said shower head body;

said second portion of said shower head body being rotatable to allow fluid to pass through said fluid passage and out at least one spray nozzle formed in said second portion;

a valve mechanism regulating the flow of water through said fluid passage, said valve mechanism in communication with said second portion such that as said second portion is rotated, said valve mechanism is moved between an open position whereby fluid passes through said fluid passage and a closed position whereby fluid is prevented from flowing through said fluid passage;

an annular surface disposed around an upper portion of said fluid passage, said annular surface in contact with a portion of said valve mechanism throughout its rotation to effectuate opening and closing of said fluid passage.

14. The shower head of claim 13, wherein said valve mechanism is maintained in contact with said annular surface by the water pressure in the shower head.

15. The shower head of claim 14, wherein said valve mechanism has a top portion which contacts said annular surface and a stem, which is secured to said second portion.

16. The shower head of claim 15, wherein the flow of water can be varied as said valve mechanism rotates between said open position and said closed position.

17. The shower head of claim 16, wherein said annular surface is cammed such that as said top portion rotates, it moves generally away from said fluid channel allowing fluid to pass therethrough.

18. The shower head of claim 16, wherein said top portion includes at least one protrusion formed on its underside which contacts said annular surface as said second portion is rotated.

19. The shower head of claim 18, wherein said annular surface has at least one groove formed therein for receipt of said at least one protrusion when said valve mechanism is in said closed position.

* * * * *